United States Patent [19]

Bertsch

[11] Patent Number: 4,500,160

[45] Date of Patent: Feb. 19, 1985

[54] ELECTRICAL CONNECTOR DEVICE

[75] Inventor: Jack Bertsch, Orchard Park, N.Y.

[73] Assignee: Polytronics, Inc., Buffalo, N.Y.

[21] Appl. No.: 612,745

[22] Filed: May 21, 1984

Related U.S. Application Data

[63] Continuation-in-part of Ser. No. 476,990, Mar. 21, 1983, abandoned.

[51] Int. Cl.[3] ..... H01R 13/50

[52] U.S. Cl. ..... 339/166 R; 339/196 R; 339/206 R; 339/209; 339/17 LC

[58] Field of Search ..... 339/154 R, 154 A, 156 R, 339/159 C, 166 R, 196 R, 196 M, 198 P, 206 R, 206 P, 209, 210 R, 210 M, 211, 17 R, 17 C

[56] References Cited

U.S. PATENT DOCUMENTS

| | | | |
|---|---|---|---|
| 2,563,561 | 8/1951 | Stanley | 339/159 C |
| 2,750,572 | 6/1956 | Fox | 339/206 P |
| 2,810,894 | 10/1957 | Kerr | 339/196 R |
| 3,775,727 | 11/1973 | Wise | 339/156 R |
| 4,028,654 | 6/1977 | Bullard et al. | 339/210 R |
| 4,080,039 | 3/1978 | Ahroni | 339/166 R |
| 4,114,971 | 9/1978 | Heimbrock | 339/210 R |
| 4,293,172 | 10/1981 | Lingaraju | 339/159 C |

*Primary Examiner*—Joseph H. McGlynn
*Assistant Examiner*—David L. Pirlot
*Attorney, Agent, or Firm*—Joseph P. Gastel

[57] ABSTRACT

A connector device for placement between a female electrical outlet and a male plug including a housing having a first end wall with a post thereon mounting a tubular member, a pair of combined elongated prongs and prong receptacles mounted on the tubular member, with the prongs extending through slots in the first end wall and the prong receptacles located within the housing, a second tubular member mounted on the first end wall for receiving a grounding pin, a second end wall mountable on the housing in opposition to the first end wall and having a post in alignment with the post on the first end wall for retaining the tubular member in position, prong-receiving slots in the second end wall in alignment with the prong receptacles, and alignment members on the second end wall for maintaining the alignment of the prong receptacles with the prong-receiving slots in the second end wall.

30 Claims, 21 Drawing Figures

10
11
13
14
17
19
20
32
44
60
61
72
72'
73
52
59
2
3

11
12
13
14
15
16
17'
18
18'
20
27
27'
28
28'
35
35'
35a
35a'
36
36'
36a
36a'
37
38
38'
39
40
41
42
43
48
48a
48a'
52
24
25
26
29

10
11
12
13
15
17
17'
19
19'
20
20'
21
22
23
24
25
26
29
31
32
37
39
40
41
42
43
44
44'
45
50
52
53
54
55
56
57
59
60
62
70
71
73
74
75
76

10
11
12
14
16
17
17'
19
19'
20'
21
24
25
26
27
29
30
31
32
33
34
34'
36'
37
44'
46a'
52
53
54
55
56
57
59
61
63
64
65
66
66'
67
67'
69
69'
70
70'
71
72
72'

Fig. 5.
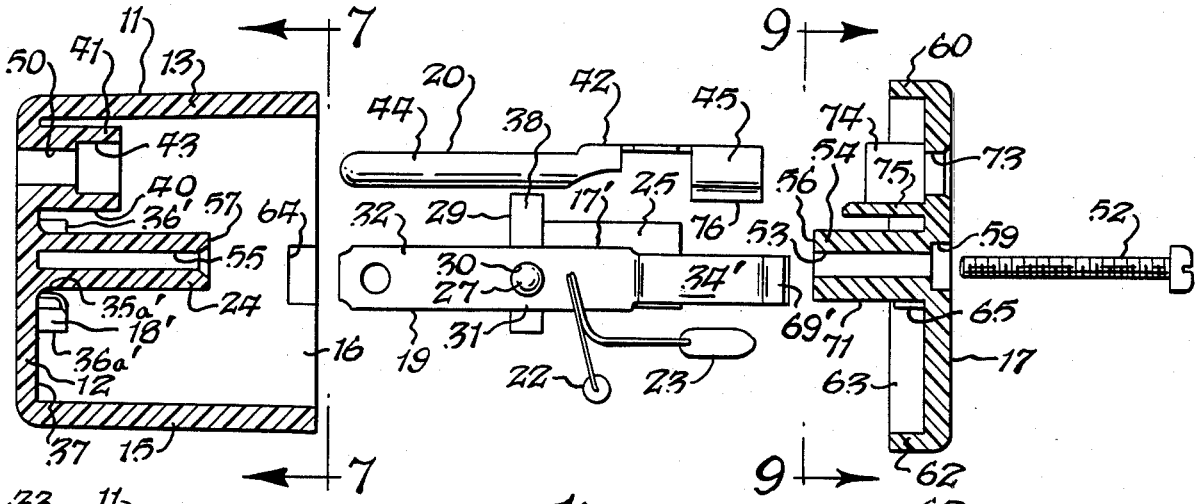
Fig. 6.
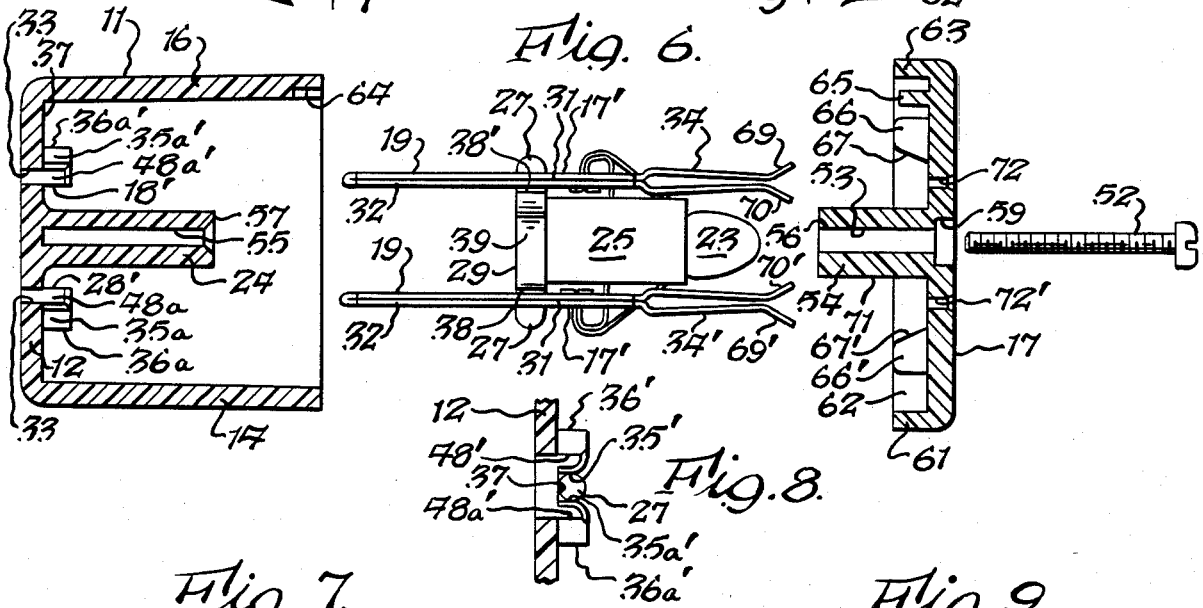
Fig. 8.
Fig. 7.
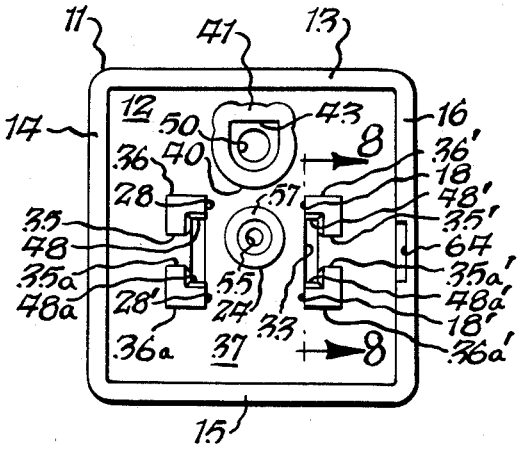
Fig. 9.
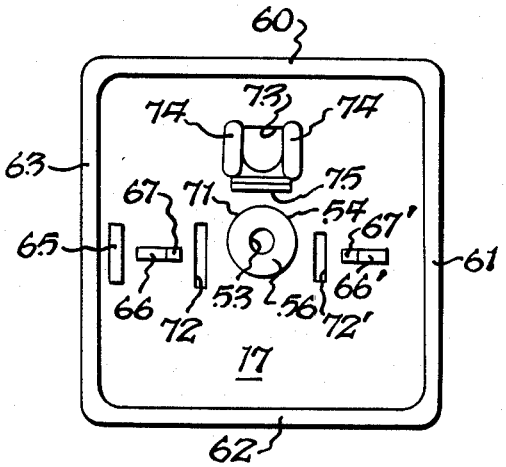

Fig. 10.
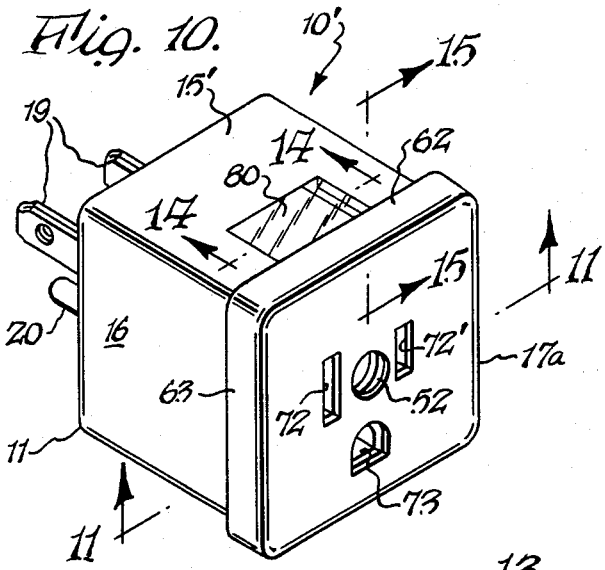
Fig. 13.
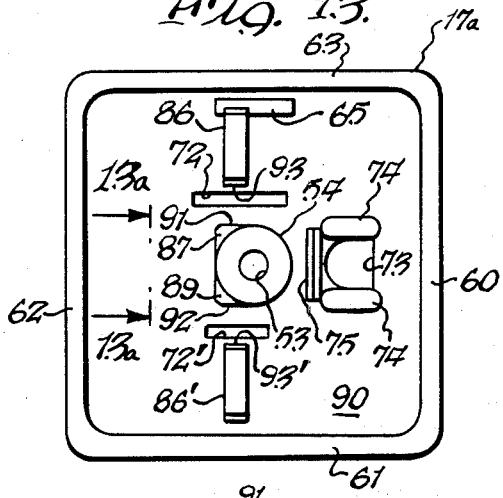
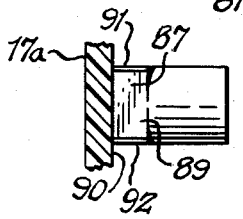
Fig. 13a.
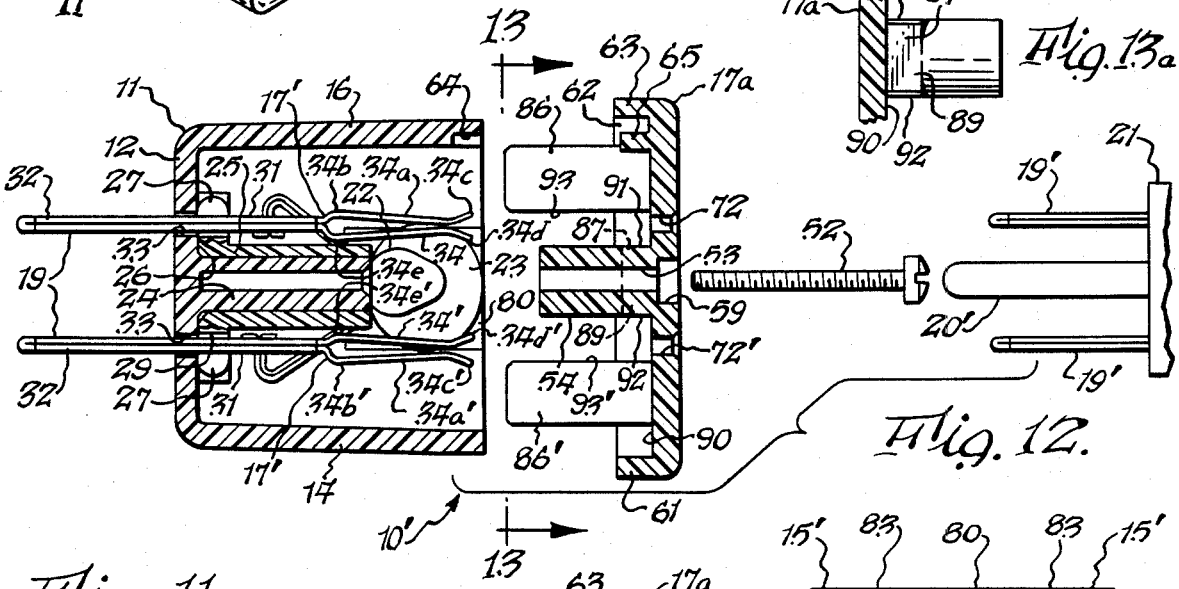
Fig. 12.
Fig. 11.
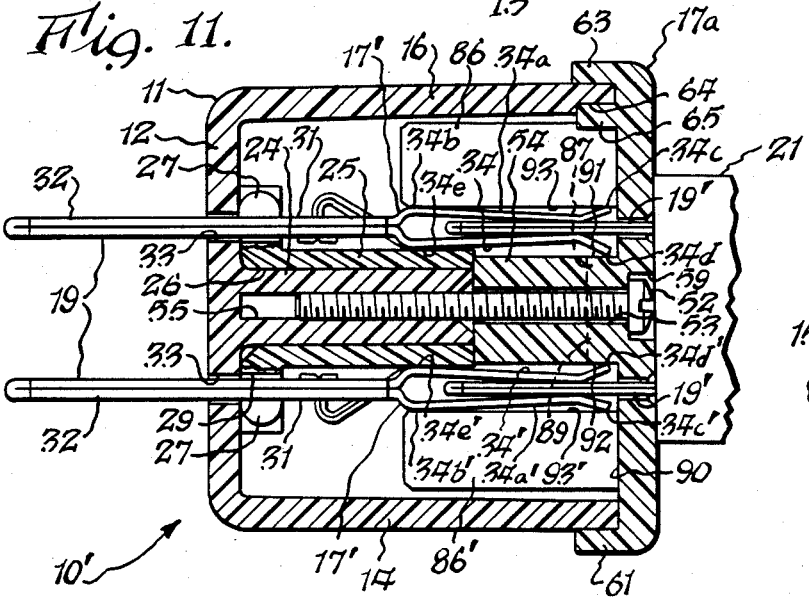
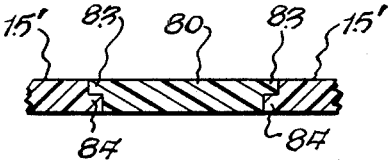
Fig. 14.
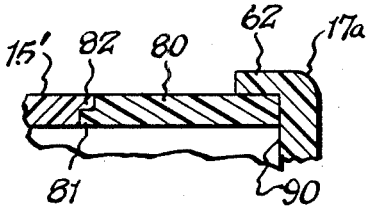
Fig. 15.

Fig. 16.
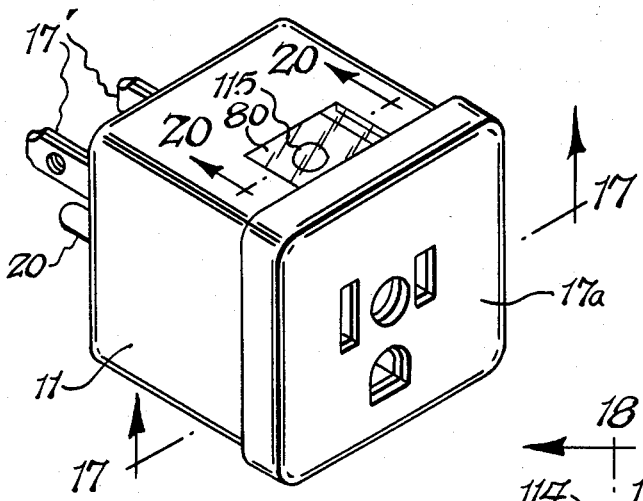
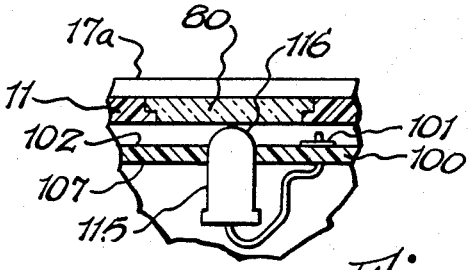
Fig. 20.
Fig. 17.
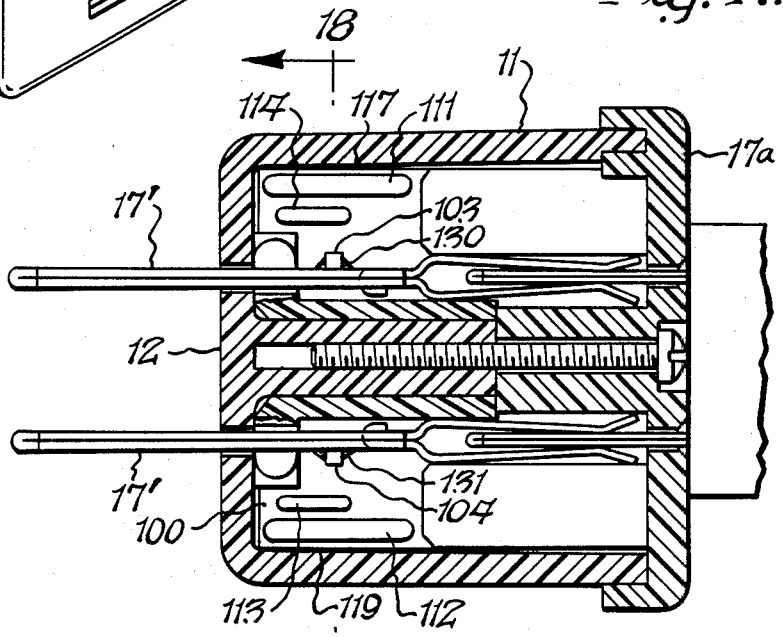
Fig. 18.
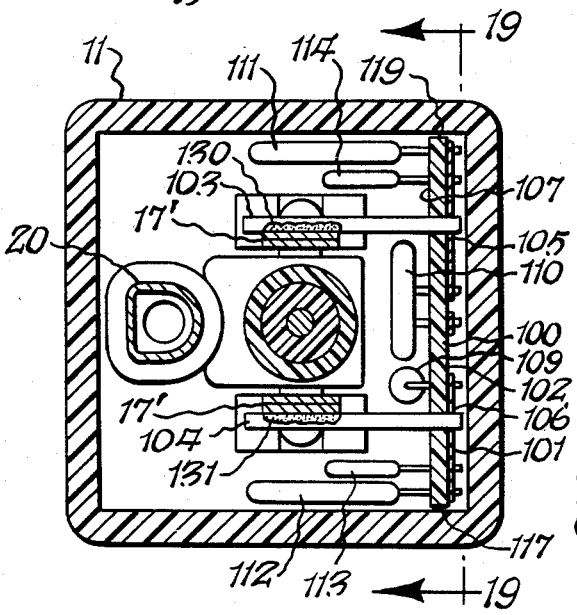
Fig. 19.
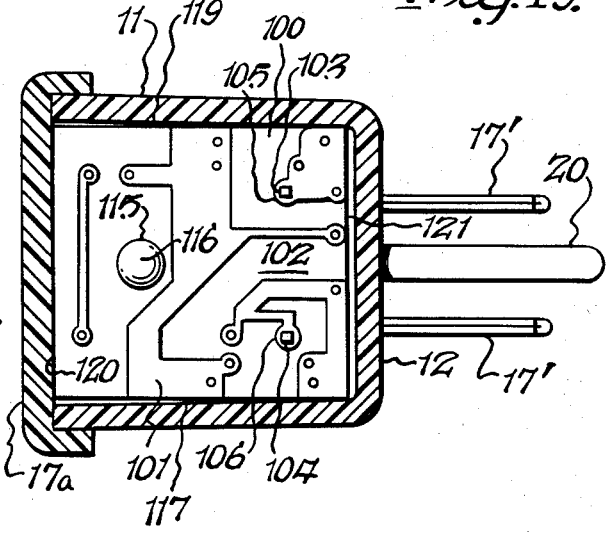

ELECTRICAL CONNECTOR DEVICE

CROSS-REFERENCE TO RELATED APPLICATION

The present application is a continuation-in-part of application Ser. No. 476,990, filed Mar. 21, 1983, now abandoned.

BACKGROUND OF THE INVENTION

The present invention relates to a connector for placement between an electrical outlet and a plug leading to an electrical device.

By way of background, numerous devices, such as voltage spike suppressors, filters, and the like, are located in a connector placed between an electrical outlet and a plug mounted on a cord leading to an electrical device. In the past, the connector was relatively complex in nature and required relatively great effort to manufacture and assemble. It is with an improved device of this type that the present invention is concerned.

SUMMARY OF THE INVENTION

It is the object of the present invention to provide an improved connector having parts which can be assembled in an extremely simple and efficient manner, and, in which the electrical parts will be supported in an extremely stable manner. Other objects and attendant advantages of the present invention will readily be perceived hereafter.

The present invention relates to a connector for placement between a female electrical outlet and a male plug comprising a housing, a first end wall on said housing, side wall means extending from said first end wall, a post extending from said first end wall within said side wall means, a pair of first slots extending through said first end wall on opposite sides of said post, a tubular member for mounting on said post in mating relationship, a pair of diametrically opposed teats extending radially outwardly from said tubular member, a pair of combined prongs and prong receptacles having prong portions at first ends extending through said slots and having prong receptacles at their second ends for receiving prongs of an external male plug, central portions on said combined prong and prong receptacles, apertures in said central portions for fitting on said teats, a second end wall mountable on said side wall means in opposition to said first end wall, a pair of second slots in said second end wall in alignment with said prong receptacles, and meas for securing said second end wall relative to said side wall means. The various aspects of the present invention will be more fully understood when the following portions of the specification are read in conjunction with the accompanying drawings wherein:

BRIEF DESCRIPTION OF THE DRAWINGS

FIG. 5 is an exploded view of the various parts of the connector, the view being partly in cross section and being taken substantially along line 2—2 of FIG. 1;

FIG. 6 is an exploded view showing the parts of the connector with the view being taken substantially along line 3—3 of FIG. 1;

FIG. 7 is a view looking into the housing in the direction of arrows 7—7 of FIG. 5;

FIG. 8 is a fragmentary cross sectional view taken substantially along line 8—8 of FIG. 7;

FIG. 9 is a view looking at the inside of the end wall in the direction of arrows 9—9 of FIG. 5;

FIG. 10 is a perspective view of another embodiment of the present invention;

FIG. 11 is a cross-sectional view taken substantially along line 11—11 of FIG. 10 and showing the structure for preventing excessive deflection of the prong receptacles;

FIG. 12 is an exploded view of the subject matter of FIG. 11;

FIG. 13 is a view taken in the direction of arrows 13—13 of FIG. 12;

FIG. 13A is a view taken in the direction of arrows 13A—13A of FIG. 13;

FIG. 14 is a cross-sectional view taken along line 14—14 of FIG. 10;

FIG. 15 is a cross-sectional view taken along line 15—15 of FIG. 10;

FIG. 16 is a perspective view of another embodiment of the present invention;

FIG. 17 is a fragmentary cross sectional view taken substantially along line 17—17 of FIG. 16;

FIG. 18 is a cross sectional view taken substantially along line 18—18 of FIG. 17;

FIG. 19 is a fragmentary view, partially in cross section, taken substantially along line 19—19 of FIG. 18; and FIG. 20 is a fragmentary cross sectional view taken subtantially along line 20—20 of FIG. 16.

DESCRIPTION OF THE PREFERRED EMBODIMENTS

Figure 1:
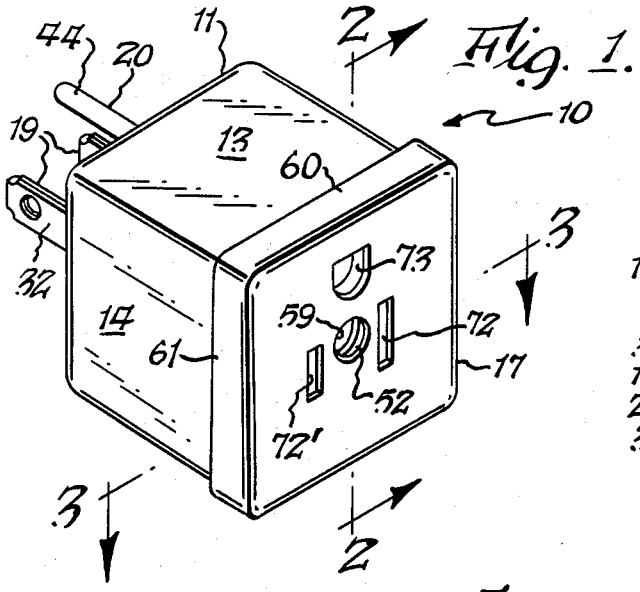
FIG. 1 is a perspective view of the improved connector of the present invention.

The improved connector 10 of the present invention includes a molded plastic housing 11 having an end wall 12 and a plurality of side walls 13, 14, 15 and 16 molded integrally therewith. An end wall 17 is secured onto housing 11 in opposition to end wall 12.

The connector 10 is for plugging into an electrical outlet having receptacles for receiving the prongs 19 and grounding pin 20 of the connector, and the connector in turn includes suitable receptacles for receiving prongs 19' and grounding pin 20' of a plug 21 mounted at the end of an electrical cord leading to an electrically operated device. The connector 10 of the present invention includes a resistor 22 and capacitor 23 mounted in parallel by leads (not numbered) across prongs 19 for the purpose of trapping voltage spikes to which the connector may be subjected, so that these spikes are not transmitted to the electrical apparatus through plug 21. However, the present invention is in no way concerned with items such as resistor 22 and capacitor 23 but is concerned with the physical constructional features of the connector.

Molded integrally with end wall 12 is a cylindrical post 24. A tubular member 25 has a cylindrical bore 26 which receives post 24 in mating engagement. A pair of teats 27 are formed integrally with generally rectangular base 29 which is an integral part of tubular member 25. Teats 27 are located on diametrically opposite sides of base 29 and are received in apertures 30 located in the central portions 31 of metal combined prongs and prong receptacles 17' having prongs 32 which extend through slots 33 in end wall 12 and having prong receptacles 34 at their opposite ends for receiving prongs 19' of plug 21. While the members 17' are standard parts and their central portions 31 were made with original apertures therein, apertures 30 are enlargements of the original apertures for receiving teats 27.

In the assembled position of tubular member 25 on post 24, one teat 27 is snugly received between sides 35 and 35*a* of locating and stabilizing bosses 36 and 36*a*, respectively, and the other teat 27 is snugly received between sides 35' and 35*a*' of bosses 36' and 36*a*, respectively, which are molded integrally with end wall 12. Bosses 36-36*a* are the mirror image of bosses 36'-36*a*'. Teats 27 rest against the inner surface 37 of end wall 12. In addition, a concave end surface 39 is provided on base 29, and surface 39 is located in contiguous relationship to convex surface 40 of follow tubular member 41 which is formed integrally with end wall 12 and which has a longitudinal axis which is substantially parallel to he longitudinal axis of post 24. Surfaces 39–40 provide a keying relationship. The central portion 42 of grounding pin 20 is received in bore 43 of tubular member 41. End portion 44 of grounding pin 20 extends outwardly through aperture 50 in end wall 12. The female portion 45 of grounding pin 20, which is located within the housing, receives the male portion 44' of grounding pin 20'.

Sides 38 and 38' of base 29 are located between sides 28-28' and 18-18', respectively, of bosses 36-36*a* and 36'-36*a*', respectively, whereby the bosses, in addition to receiving teats 27 and locating prongs 19, also stabilize tubular member 25 against rotation about post 24. In addition, the right angle corners 48-48*a* and 48'-48*a*' of bosses 36-36*a* and 36'-36*a*', respectively, receive the outer side portions of the central portions 31 of the prong members 19 in nesting relationship to thereby stabilize them against excessive sidewise movement. In addition, the internal surface 43 of tubular member 41 receives the central portion 42 of grounding pin 20 in comlementary mating relationship, the prong end of grounding member 20 extending through aperture 50 in end wall 12.

A cover-like end wall 17 is secured to side walls 13, 14, 15 and 16 by means of a screw 52 which extends through bore 53 in post 54, which is molded integrally with end wall 17 and is threadably received in bore 55 of post 24. The end 56 of post 54 bears against the end 57 of tubular member 24 and thus prevents it from moving axially. A repression 59 receives the head of screw 52. Flanges 60, 61, 62 and 63 of end wall 17 overlie the edge portions of side walls 13, 14, 15 and 16, respectively, as shown in the drawings. In addition, a relieved portion 64 is provided in wall 16 to receive key 65 formed integrally with end wall 17 so that the end wall 17 can be mounted only in one position, that is, in the position wherein relief portion 64 receives key 65.

Bosses 66 and 66', which are molded integrally with end wall 17, include surfaces 67 and 67', respectively, which lie in contiguous relationship to the outer ends 69 and 69', respectively, of the prong receptacles 34 and 34', respectively. Thus, ends 69 and 69' cannot deflect outwardly beyond surfaces 67 and 67'. In addition, the outer ends 70 and 70' of the prong receptacles at 34 and 34', respectively, are located adjacent the cylindrical outer surface 71 of tubular member 54, which limits the inward movement of portions 70 and 70'. The centerline of prong receptacles 34 and 34' are in line with slots 72 and 72', respectively, in end wall 17 so that the prongs 19' entering slots 72 and 72' will thus be received in aligned female portions 34 and 34'.

In addition, an aperture 73 is provided in end wall 17 for receiving grounding pin 20' of plug 21. Flanges 74. which are molded integrally with end wall 17, are located on opposite sides of aperture 73 for guiding prong 20' into female portion 45 of grounding pin 20. In addition, a flange 75 bears agaist the side 76 of prong receptacle 45 to prevent it from deflecting toward post 54.

Figure 4:
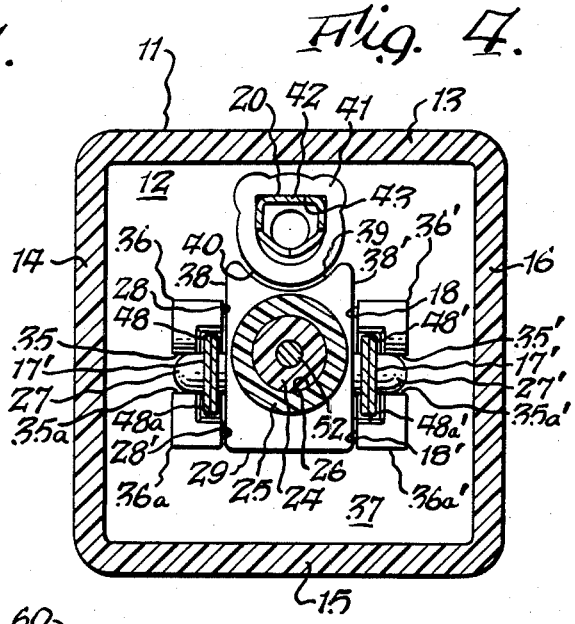
FIG. 4 is a cross sectional view taken substantially along line 4—4 of FIG. 2.
Figure 2:
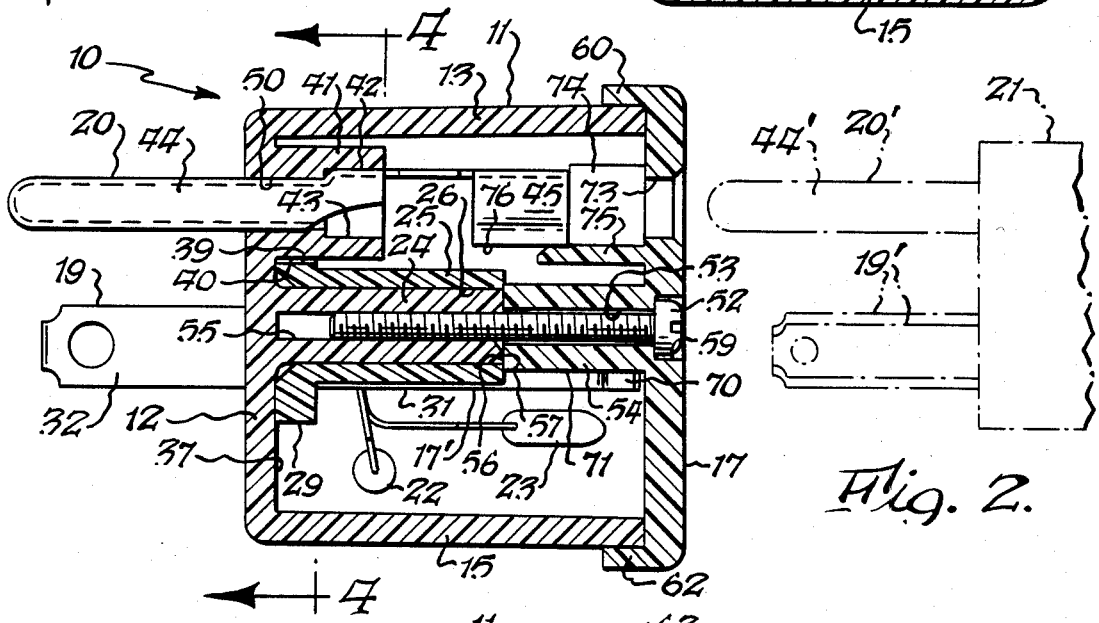
FIG. 2 is a fragmentary cross sectional view taken substantially along line 2—2 of FIG. 1 and also showing in phantom a male plug in position to enter the connector.
Figure 3:
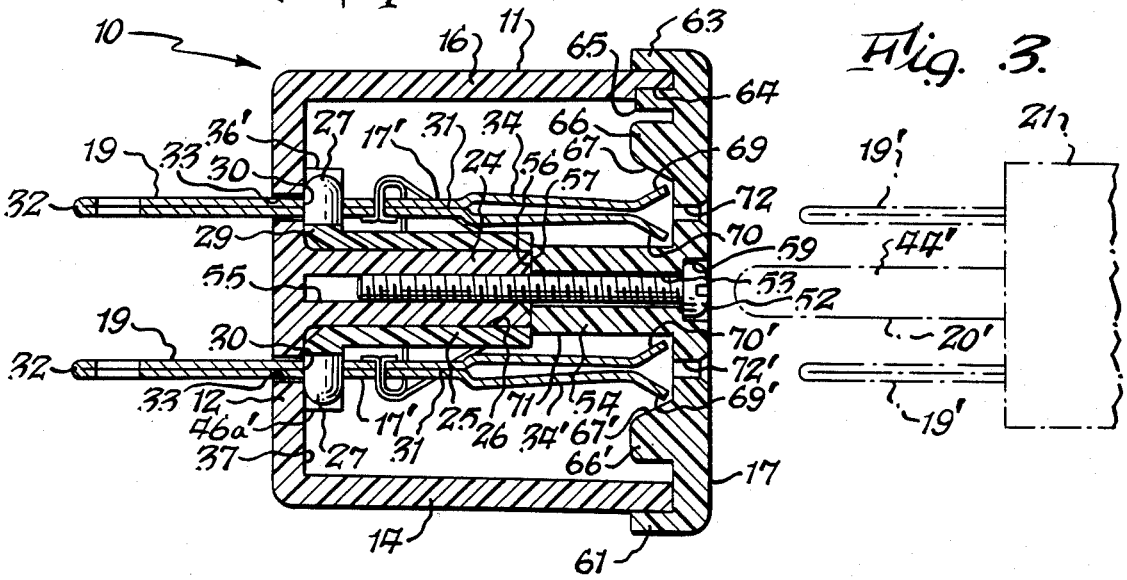
FIG. 3 is a cross sectional view taken substantially along line 3—3 of FIG. 1 and showing in phantom a male plug in position to enter the connector.

In FIGS. 10–15 a modified embodiment of the present invention is shown which possesses two basic differences over the embodiment of FIGS. 1–9. The first difference relates to a window 80 in side wall 15'. The second difference relates to the structure of end wall 17*a*. The remaining structure of connector 10' is identical to that described above in FIGS. 1–9, and accordingly identical numerals will designate identical elements of structure, thereby obviating the necessity for a repetitive description.

Window 80 in wall 15', which is analogous to wall 15 of FIGS. 1–9, permits viewing of the capacitor 23 to determine whether it has burned out. Window 80 (FIGS. 10, 14 and 15) includes a flanged end 81 which fits in complementary mating engagement with flanged portion 82 of wall 15'. Window 80 also includes flanged ends 83 which fit in mating engagement with flanged sides 84 of wall 15'. When flange 62' of end wall 17*a* is in its mounted position as shown in FIGS. 10 and 15, it will hold window 80 in position in combination with the flanged portions 81–82 and 83–84.

End wall 17*a* differs from end wall 17 of FIGS. 1–9 in that it has enlarged bosses 86 and 86' rather than smaller bosses 66 and 66' of FIGS. 1–9. In addition, protuberances 87 and 89 are provided at the juncture of post 54 and inner surface 90 of end wall 17*a* so as to provide side surfaces 91 and 92, respectively, (FIGS. 13 and 13*a*). When end wall 17*a* is in mounted relationship, edges 93 and 93' of bosses 86 and 86', respectively, will lie in contiguous relationship to prong receptacle portions 34*a* and 34*a*' to limit their outward movement. More specifically, it can be seen from FIG. 11 that areas 34*b* and 34*c* are immediately adjacent edge 93 and that areas 34*b*' and 34*c*' are immediately adjacent edge 93'. Thus, edges 93 and 93' will prevent outward movement of prong receptacle portions 34*a* and 34*a*'. In addition to the foregoing, side 92 of protuberance 89 is immediately adjacent portion 34*d*' of prong receptable 34' and side 91 of protuberance 87 is immediately adjacent portion 34*d* of prong receptacle 34. Also, areas 34*e* and 34*e*' of prongs receptacles 34 and 34', respectively, are immediately adjacent cylindrical tubular member 25 which limits movement of these portions of the prong receptacles. It can thus be seen that when prongs 19' are inserted into prong receptacles 34 and 34', a good tight fit will be maintained because the bosses 86 and 86' and protuberances 87 and 89 and the member 25 limit the outward movement of the sides of the prong receptacles and thus prevent the connection between prongs 19' and the prong receptacles from becoming loosened.

In FIGS. 16–20 a still further embodiment of the present invention is shown. This embodiment includes all of the basic structure described above in detail relative to FIGS. 10–15, and therefore, in the interest of brevity, this structure will not again be described. The only difference between the embodiment of FIGS. 16–20 and the above-described embodiment of FIGS. 10–15 is that a circuit board is firmly attached to prong receptacles 17' and is electrically coupled to grounding pin 20. More specifically, circuit board 100 includes a printed circuit 101 on surface 102 thereof. Conductive metal rods 103 and 104 are soldered at 130 and 131, respectively, to prong receptacles 17' as shown in FIGS. 17 and 18. The remote ends extend through and are tightly received in holes (not numbered) in circuit board 100. The holes in the circuit board which receive rods 103 and 104 are of substantially the same size and shape as the cross sections of the rods 103 and 104. In addition, the ends of rods 103 and 104 are soldered in electrical contact with the printed circuit at 105 and 106, respectively. Thus, there is a rigid coupling between the circuit board and rods 103 and 104. A resistor 109 and a plurality of capacitors 110, 111, 112, 113 and 114 are located on side 107 of the printed circuit board 100 and have leads (not numbered) which are in electrical contact with the printed circuit on side 102. A lead wire, not shown, is in electrical contact with grounding pin 20 and the printed circuit board. The electrical aspect of the printed circuit forms no part of the present invention. A red bulb 115 is mounted on the circuit board 100 with the outer end 116 of the red bulb immediately adjacent window 80. The red bulb 115 will remain lit as long as the circuit is operating properly, and if any part of the circuit should fail, the lamp 115 will no longer light up.

Because rods 103 and 104 are soldered to members 17' and because there is a tight fit and soldered connections between rods 103 and 104 and the circuit board, the printed circuit board, through rods 103 and 104, aids in stabilizing prong receptacles 17', especially considering that there is very little play between the edges 117 and 119 of the circuit board and the adjacent sides of the housing 11, and because there is very little play between the edges 120 and 121 of the circuit board and the adjacent portions of the end wall 17*a* and the end wall 12.

It can thus be seen that the improved connector device is manifestly capable of achieving the above enumerated objects and while a preferred embodiment of the present invention has been disclosed, it will be appreciated that the present invention is not limited thereto but may be otherwise embodied within the scope of the following claims.

What is claimed is:

1. A connector device for placement between a female electrical outlet and a male plug comprising a housing, a first end wall on said housing, side wall means extending from said first end wall, a first post extending from said first end wall within said side wall means, a pair of first slots extending through said first end wall on opposite sides of said first post, a tubular member for mounting on said first post in mating relationship, a pair of diametrically opposed teates extending radially outwardly from said tubular member, a pair of combined prongs and prong receptacles having prong portions at first ends extending through said slots and having prong receptacles at their second ends for receiving prongs of an external male plug, central portions on said combined prong and prong receptacles, apertures in said central portions for fitting on said teats, a second end wall mountable on said side wall means in opposition to said first end wall, a pair of second slots in said second end wall in alignment with said prong receptacles, and means for securing said second end wall relative to said side wall means.

2. A connector device as set forth in claim 1 including means for preventing relative rotation between said first post and said tubular member.

3. A connector device as set forth in claim 2 wherein said means for preventing relative rotation comprises a key member on said first end wall, and a key receiving slot on said tubular member.

4. A connector device as set forth in claim 1 including stabilizing members on said first end wall for receiving said central portions therebetween.

5. A connector device as set forth in claim 4 wherein said stabilizing members comprise two pairs of stabilizing members, and wherein one of said teats is positioned between each pair of stabilizing members.

6. A connector device as set forth in claim 4 including base means on said tubular member located between said pairs of stabilizing members.

7. A connector device as set forth in claim 1 including second post means on said second end wall in axial alignment with said tubular member for holding said tubular member against axial movement on said first post.

8. A connector device as set forth in claim 7 including a first bore in said second post terminating at an aperture in said second end wall, a second bore in said first post in alignment with said first bore, and a screw extending through said aperture and first bore and being threadably received in said second bore to maintain said second end wall in assembled relationship with said side wall means.

9. A connector device as set forth in claim 7 including means for preventing relative rotation between said first post and said tubular member.

10. A connector device as set forth in claim 9 wherein said means for preventing relative rotation comprises a key member on said first end wall, and a key-receiving surface on said tubular member.

11. A connector device as set forth in claim 7 including stabilizing members on said first end wall for receiving said central portions therebetween.

12. A connector device as set forth in claim 11 wherein said stabilizing members comprise two pairs of stabilizing members, and wherein a teat is located between each pair of stabilizing members.

13. A connector device as set forth in claim 11 including base means on said tubular member located between said pairs of stabilizing members.

14. A connector device as set forth in claim 1 including a second tubular member extending from said first end wall within said side wall means and in substantially parallel relationship to said first post, an aperture in said first end wall in alignment with said second tubular member, and a grounding pin having a pin portion at one end extending through said aperture and a grounding pin receiving portion at its opposite end within said side wall means for receiving an external grounding pin and a central grounding pin portion received within said second tubular member, and a second aperture in said second end wall in alignment with said grounding pin receiving portion.

15. A connector device as set forth in claim 14 including guide means on said second end wall and located within said side wall means for guiding said external grounding pin into said grounding pin receiving portion.

16. A connector device as set forth in claim 15 including alignment means for maintaining said grounding pin receiving portion in alignment with said second aperture.

17. A connector device as set forth in claim 1 including limiting means on said second end wall for limiting spreading of said prong receptacles in an inward direction.

18. A connector device as set forth in claim 17 including second limiting means on said second end wall for limiting spreading of said prong receptacles in an outward direction.

19. A connector device as set forth in claim 17 including second post means on said second end wall in axial alignment with said tubular member for holding said tubular member against axial movement of said first post, and wherein said limiting means comprises the outer surface of said second post means.

20. A connector device as set forth in claim 1 including limiting means on said second end wall for limiting spreading of said prong receptacles in an outward direction.

21. A connector device as set forth in claim 20 wherein each of said prong receptacles include inner and outer members and wherein said limiting means comprises first and second elongated bosses extending lengthwise of said outer members.

22. A connector device as set forth in claim 21 wherein said outer members of said prong receptacles include outer end portions and inner end portions between said outer end portions and said teats, and wherein said outer end portions and said inner end portions are positioned in contiguous relationship to said elongated bosses.

23. A connector device as set forth in claim 22 wherein said inner members include outer end portions and inner end portions between said outer end portions and said teats and wherein said limiting means includes protuberance means on said second end wall in spaced relationship to said bosses and in contiguous relationship to said outer end portions of said inner members.

24. A connector device as set forth in claim 23 wherein said limiting means includes an outer surface of said tubular member in contiguous relationship to said inner end portions of said inner members.

25. A connector device as set forth in claim 1 including a printed circuit board, and a pair of rods, first ends on said rods rigidly mounted on said central portions of said combined prong receptacles, and second ends on said rods rigidly mounted on said circuit board.

26. A connector device as set forth in claim 25 wherein said printed circuit board has a close fit with said side wall means and with said first and second end walls.

27. A connector device for placement between a female electrical output and a male plug comprising a housing, a first end wall on said housing, side wall means extending from said first end wall, a post extending from said first end wall within said side wall means, a pair of first slots extending through said first end wall on opposite sides of said post, a tubular member for mounting on said post in mating relationship, a pair of combined prongs and prong receptacles having prong portions at first ends extending through said slots and having prong receptacles at their second ends for receiving prongs of an external male plug, central portions on said combined prong and prong receptacles, means mounting said central portions on said tubular member, a second end wall mountable on said side wall means in opposition to said first end wall, a pair of second slots in said second end wall in alignment with said prong receptacles, means for securing said second end wall relative to said side wall means, a printed circuit board, a pair of rods, first ends on said rods rigidly mounted on said central portions, and second ends on said rods rigidly mounted on said circuit board.

28. A connector device as set forth in claim 27 including a window on said side wall means, and an indicator lamp mounted on said circuit board and located proximate said window.

29. A connector device as set forth in claim 27 wherein said printed circuit board has a close fit with said side wall means.

30. A connector device as set forth in claim 27 wherein said printed circuit board has a close fit with at least one of said end walls.

* * * * *

UNITED STATES PATENT AND TRADEMARK OFFICE

CERTIFICATE OF CORRECTION

PATENT NO. : 4,500,160

DATED : February 19, 1985

INVENTOR(S) : Jack Bertsch

It is certified that error appears in the above-identified patent and that said Letters Patent are hereby corrected as shown below:

Column 1, line 52, change "meas" to --means--.
Column 3, line 23, change "follow" to --hollow--;
line 26, change "he" to --the--;
line 55, change "repression" to --depression--.
Column 4, line 14, change "agaist" to --against--.
Column 5, line 54, (claim 1), cancel "first";
line 57, (claim 1), cancel "first";
line 58, (claim 1), cancel "first";
line 59, (claim 1), change "teates" to --teats--.
Column 6, line 5, (claim 2), cancel "first";

line 16, (claim 5), change "one of said teats" to --a teat--;
line 24, (claim 7), cancel "first";
line 35, (claim 9), cancel "first";

line 54, (claim 14), cancel "first".
Column 7, line 16, (claim 19), change "of" to --on--, and cancel "first".

Signed and Sealed this

*Seventeenth* Day of *December 1985*

[SEAL]

*Attest:*

DONALD J. QUIGG

*Attesting Officer*

*Commissioner of Patents and Trademarks*